US006328408B1

(12) United States Patent
Gelbart

(10) Patent No.: US 6,328,408 B1
(45) Date of Patent: Dec. 11, 2001

(54) MULTIPLE PASS INK JET RECORDING

(75) Inventor: Daniel Gelbart, Vancouver (CA)

(73) Assignee: Creo S.R.L., Holetown (BB)

( * ) Notice: Subject to any disclaimer, the term of this patent is extended or adjusted under 35 U.S.C. 154(b) by 0 days.

(21) Appl. No.: 09/107,902

(22) Filed: Jun. 19, 1998

(51) Int. Cl.[7] ..... B41J 2/015

(52) U.S. Cl. ..... 347/20; 347/101; 347/105; 347/102

(58) Field of Search ..... 347/101, 102, 347/20, 105

(56) References Cited

U.S. PATENT DOCUMENTS

| | | | | |
|---|---|---|---|---|
| 4,308,542 | * | 12/1981 | Maekawa et al. | 346/1.1 |
| 4,943,818 | * | 7/1990 | Hotomi | 346/140 R |
| 5,099,256 | * | 3/1992 | Anderson | 346/1.1 |
| 5,249,062 | * | 9/1993 | Ejiri et al. | 358/296 |
| 5,313,232 | * | 5/1994 | Peer | 347/20 |
| 5,405,678 | * | 4/1995 | Bilodeau | 428/211 |
| 5,873,315 | * | 2/1999 | Codos | 112/117 |
| 5,984,467 | * | 11/1999 | Bodager et al. | 347/101 |
| 6,015,624 | * | 1/2000 | Williams | 347/101 |
| 6,057,026 | * | 5/2000 | Tsuchiya et al. | 347/105 |
| 6,092,890 | * | 7/2000 | Wen et al. | 347/101 |
| 6,162,485 | * | 12/2000 | Chang | 427/1 |

FOREIGN PATENT DOCUMENTS

| | | | | |
|---|---|---|---|---|
| 58-132586 | * | 8/1983 | (JP) . | |
| 64-36478 | * | 2/1989 | (JP) . | |
| 01-159287 | * | 6/1989 | (JP) . | |
| WO96/23105 | * | 1/1995 | (WO) | D21H/21/16 |

* cited by examiner

*Primary Examiner*—John Barlow
*Assistant Examiner*—Manish S. Shah
(74) *Attorney, Agent, or Firm*—Oyen Wiggs Green & Mutala

(57) ABSTRACT

High resolution ink jet printing is achieved by using a completely hydrophobic layer on a substrate and allowing droplets to dry before permanently bonding to the substrate. In shadow and solid areas, the ink droplets may coalesce before the carrier liquid evaporates corrupting the printed image. Several multiple pass techniques, herein disclosed, eliminate the quality degradation from coalescing of non-wetted ink droplets. The simplest solution involves printing shadows or solids on a hydrophobic surface in a plurality of passes, wherein the ink droplets of each pass are applied sufficiently far apart to avoid touching adjacent droplets and are evaporated prior to commencing a subsequent pass. Alternatively, ink applied in shadow and solid areas wets the bare substrate in a pass prior to application (or subsequent to removal) of the hydrophobic coating. Highlights are inked in a second pass when the hydrophobic coating is present on the substrate. These techniques preserve the advantages of resolution and quality afforded by using the hydrophobic surface, but eliminate the problems associated with fusion of non-wetted liquid ink droplets.

14 Claims, 6 Drawing Sheets

MULTIPLE PASS INK JET RECORDING

RELATED APPLICATION

This application is related to a co-owned application entitled IMPROVED RESOLUTION INK JET PRINTING, filed on Apr. 29, 1998, by inventor Daniel Gelbart (U.S. patent application Ser. No. 09/071,295). Hereinafter, this related patent application is referred to as Gelbart.

FIELD OF THE INVENTION

The invention relates to the field of ink jet printing. Ink jet printing is primarily concerned with printing on paper, but the invention disclosed herein is also useful for printing on other substrates such as lithographic and flexographic printing plates.

BACKGROUND OF THE INVENTION

All inks used in ink jet printing today wet the substrate they are deposited on, because wetting is key to adhesion and durability of the finished product. The terms "wetting" and "non-wetting" refer to the appearance of the liquid droplet on the substrate before it evaporates or solidifies Most inks used in ink jet printing today are aqueous based inks containing colorants, which are pigments or dyes dissolved in water based carrier liquids. The term "colorant" is used throughout this application in a generic sense and covers any component of the ink which remains after the carrier liquid evaporates, even if the primary use of the ink in not as a color. An area on a printed surface is classified in the art by the amount of ink which is applied to that area. A "solid" region is completely inked, a "shadow" region is inked over a significant percentage of the printing area with a small percentage remaining un-inked, and finally, a "highlight" region is largely devoid of ink, with inking occurring only on a small percentage of the region.

FIG. 1. shows the prior art, in which a droplet 1 is ejected from a nozzle 2 onto a substrate 3, normally paper. After a few milliseconds of bouncing (FIGS. 1-*a,* 1-*b,* 1-*c*) the droplet starts to wet the substrate as shown in FIG. 1-*d.* The wetting manifests itself as lowering of the contact angle ø to well below 90°. The substrate simultaneously absorbs the ink, leaving behind some colorant inside the substrate as the liquid evaporates or solidifies. The dry droplet, FIG. 1-*e,* shows some colorant absorbed into the substrate. It is also known in the art that heating the printed substrate can increase adhesion and durability of the ink (see for example U.S. Pat. No. 4,308,542).

Wetting is an essential part of all prior art ink jet applications. If the substrate is coated with a material capable of interfering with wetting, the material must be treated to permit wetting. A non-wettable surface may be made porous to promote wetting because increasing a material's surface area increases its surface energy, and increasing surface energy increases wetting. Some materials, which will not wet when applied in a continuous and smooth layer, will wet well when made porous. Porous coatings form the basis of U.S. Pat. No. 5,405,678, which uses a hydrophobic latex to improve the characteristics of a paper substrate. The latex is applied to the paper, but the latex particles on the paper surface are not permitted to coalesce. The significance of leaving the surface porous is clearly stated in U.S. Pat. No. 5,405,678 (column 6, lines 13–30). U.S. Pat. No. 5,405,678 also recommends mixing a strongly hydrophilic material, such as aluminum silicate or activated clay, to promote wetting. Similar ideas of surface coatings which use broken-up or interrupted hydrophobic materials are shown in Japanese patents 1-159287, 64-36478, and 58-132586.

The major disadvantage of wetting is that the ink droplets generate dot sizes which are too large for high quality printing, particularly in the highlight areas of pictures, where ink is often applied one droplet at a time. The problems are augmented when wetting is followed by absorption into the paper fibers, which causes the dot created by the ink droplet to grow in an irregular fashion.

U.S. Pat. No. 5,099,256, issued to Anderson, discloses a technique that substantially reduces wetting of a paper recording medium by ink droplets. Anderson employs an intermediate non-wettable drum surface on which ink droplets are sprayed and then substantially dehydrated before they are transferred to the final paper recording medium. The Anderson invention helps to reduce the amount of wetting on a paper recording medium and thereby reduces the dot size, dot irregularity and color to color bleeding. The need for an intermediate drum with a specialized surface finish is a major drawback. Any wear on the specialized finish will render the invention useless.

Gelbart, a co-owned application, discloses an ink jet printing process for generating smaller, improved definition dots, particularly when using water based inks The process described therein can also be used to generate printing plates for other methods of printing, such as lithographic and flexographic printing plates, and to produce etch resists to act as masks during etching. Gelbart discloses a process wherein a substrate is treated with a thin coating of a hydrophobic material and aqueous liquid ink is applied via a ink jet nozzle to the hydrophobic coating. The hydrophobic coating prevents the ink droplets from wetting the surface and the high surface tension of the water in the ink causes the ink droplets to remain spherical in shape. As the water and other carrier liquids evaporate, a small and very dense dot of colorant remains on the surface. In some cases, the colorant is fused to the substrate using heat to increase durability. Alternatively, a protective overcoat may be applied atop of the printed surface which may serve to maintain the integrity of the non-wetted ink dots.

The process taught by Gelbart works extremely well for highlights, but suffers some shortcomings when printing in solid or shadow areas. Because of the close proximity of the aqueous ink droplets when printing in solid or shadow areas, and the spherical shape of the non-wetted droplets on the hydrophobic surface, the ink droplets tend to coalesce before the aqueous liquids can evaporate. This coalescing phenomenon causes distortion and quality degradation in the printed image.

The principal object of this invention is to provide a process of ink jet printing, wherein the increased resolution and performance described in Gelbart can be maintained in highlight areas without sacrificing printing quality in solid or shadow areas. A second object of the invention is to generate printing plates for other methods of printing (including lithographic and flexographic printing) using the same process. A final object of the invention is to directly deposit chemically resistant coatings, particularly etch resists to be used as masks during etching using the same procedure.

SUMMARY OF THE INVENTION

The first embodiment of the present invention concerns a method of ink jet printing onto a surface comprising a substrate coated with a thin non-wettable hydrophobic layer. The method may involve applying a first set of ink droplets to the hydrophobic layer. The first set of ink droplets may be applied to highlight, shadow and solid areas; however, in the solid and shadow areas the ink droplets must be applied sufficiently far apart to avoid coalescing. The ink droplets which have water based carrier liquids do not wet the non-wettable hydrophobic layer. After the first applying step, the carrier liquid from the first set of ink droplets may be evaporated leaving behind a first set of small colorant dots. A second ink application step may then be administered, wherein a second set of ink droplets is applied to the shadow and solid areas. Again, the second set of ink droplets must be applied such that they are sufficiently far apart to avoid coalescing but additionally, the second set of ink droplets must be interleaved with the first set of colorant dots so as to further the completion of printing in said shadow and solid areas. The carrier liquid from the second set of ink droplets may then be evaporated, leaving behind a second set of small colorant dots. Finally, the second application and evaporation steps may be repeated a number of times, until the required ink coverage of the shadow and solid areas is achieved.

A second aspect of this invention involves printing solids and shadow on bare wettable substrate (i.e. printing on the substrate in a conventional manner which may include wetting or any other conventional means) and then printing highlight areas on a hydrophobic layer. Two methods may be used to achieve this aspect of the invention.

In a first method, a substrate may be coated with a non-wettable hydrophobic layer before a first set of ink droplets is applied to the non-wettable hydrophobic layer in the highlight areas. The first set of ink droplets does not wet the non-wettable hydrophobic layer and may be evaporated to leave behind a first set of small colorant dots. The non-wettable hydrophobic surface may then be removed. some hydrophobic material may remain underneath the small dots, but this does not affect the other areas. Finally a second set of ink droplets may be applied to the substrate in the shadow and solid areas The second set of ink droplets may interact with the substrate in a conventional manner which may include wetting or some other means.

In a second method, the substrate may be left exposed for a first application step, wherein a first set of ink droplets is applied to the shadow and solid areas. The first set of ink droplets may interact with the substrate in a conventional manner which may include wetting or some other means. After applying ink to the shadow and solid areas, a thin hydrophobic layer may be applied on top of the substrate. A second application step may then apply a second set of ink droplets to the highlight areas. Since, the second set of ink droplets will not wet the hydrophobic layer, their carrier liquid must be evaporated leaving a small set of colorant dots in the highlight areas.

This aspect of the invention allows the advantages of small dot size and better resolution in the highlight areas (by prohibiting wetting), while maintaining the integrity of the printed images in the shadow and solid areas (by permitting wetting or any other conventional interaction between droplets and the substrate).

DESCRIPTION OF THE PREFERRED EMBODIMENT

The three embodiments envisaged in this invention are outlined below with reference to the drawings. While the preferred embodiment will be described mainly in terms of using aqueous liquid ink to print on a paper substrate, it should be interpreted in a generic way, covering the generation of printing plates for other methods of printing (including lithography and flexography) and the deposition of chemically resistant coatings, particularly etch resists, to be used as masks during etching, using the same procedure.

Figure 1:
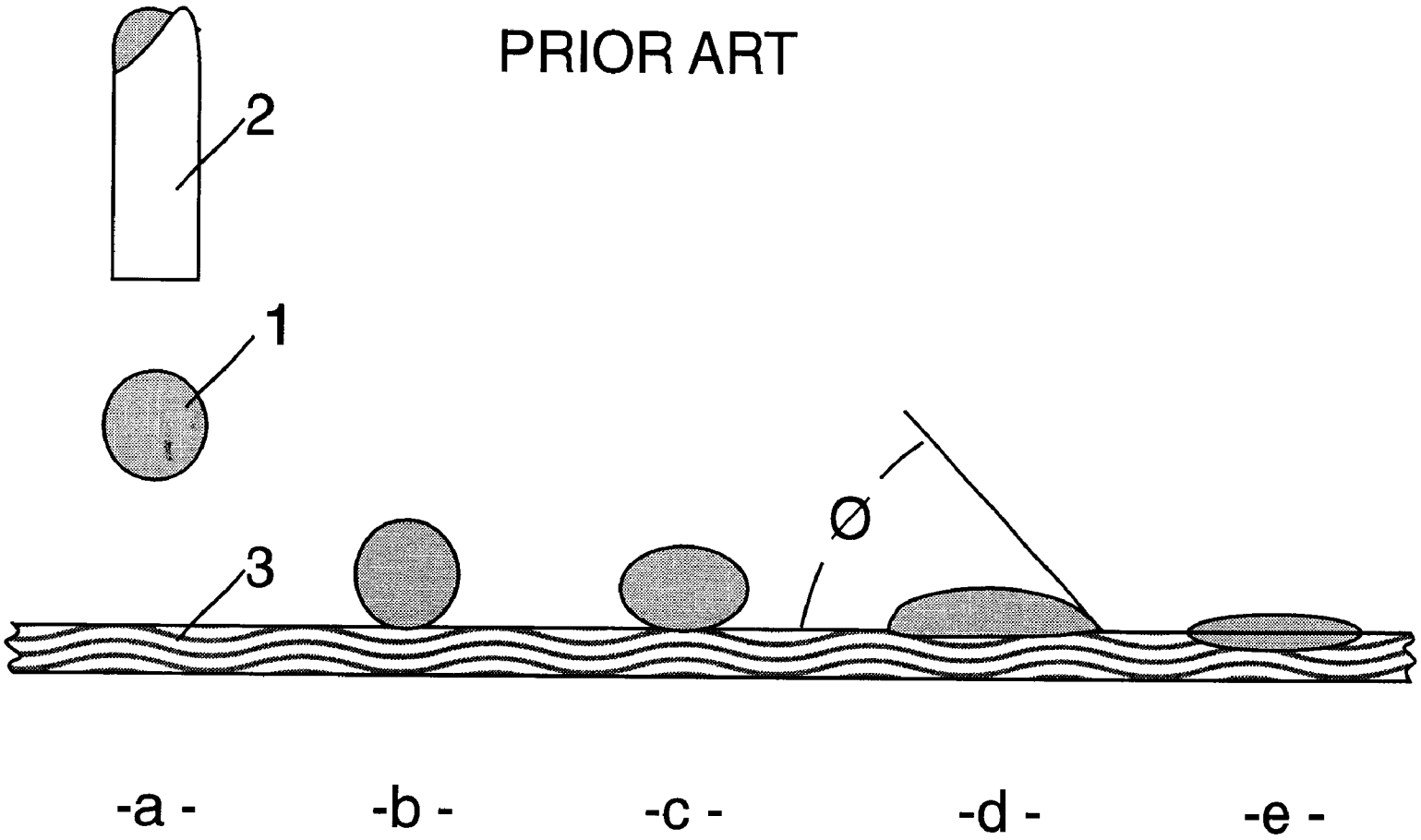
FIG. 1 depicts the steps in the prior art of ink jet printing, where the ink droplets wet the surface of the substrate.
Figure 2:
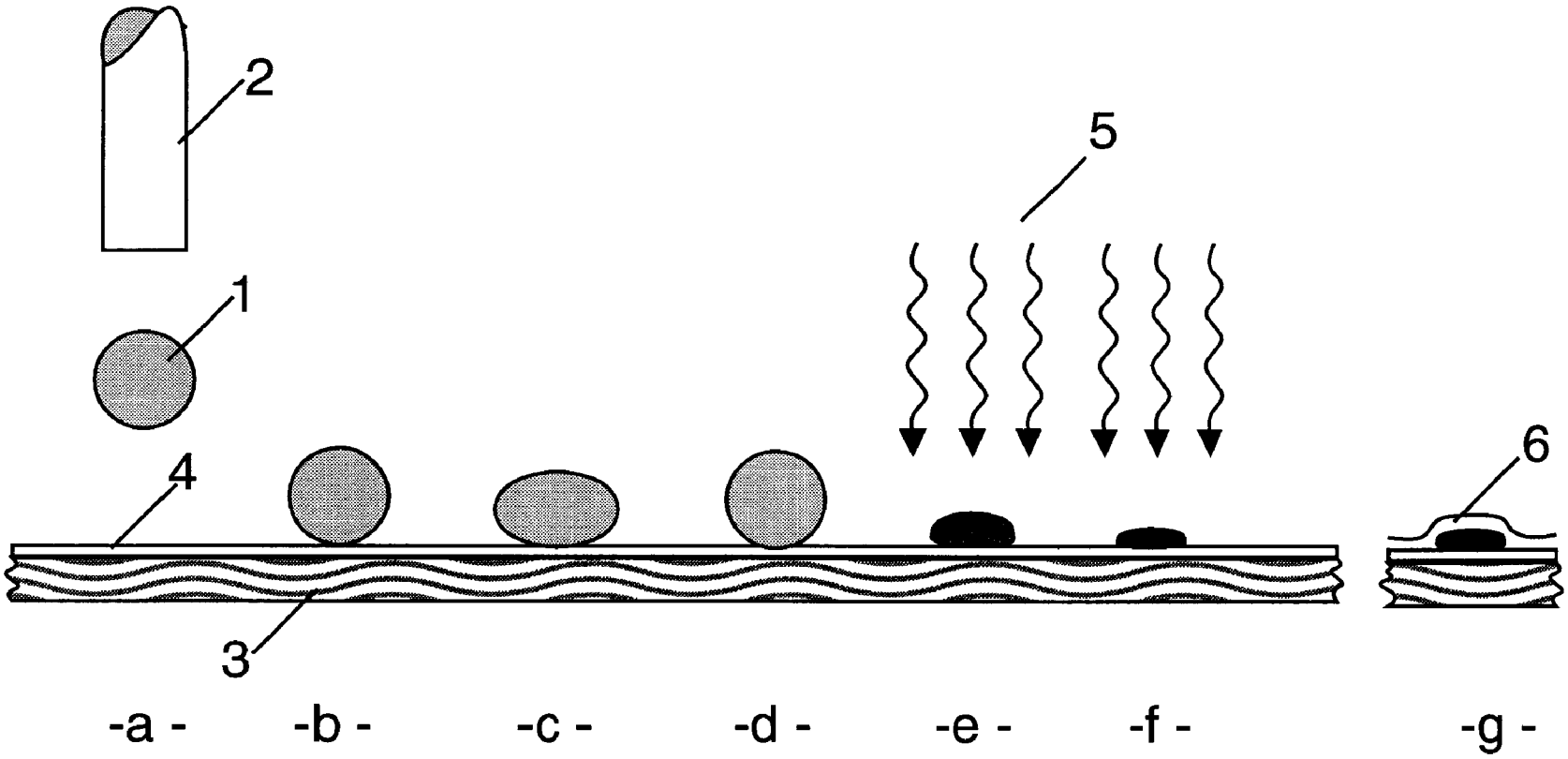
FIG. 2 displays the steps in the Gelbart process, where the ink droplets do not wet the substrate because there is a hydrophobic coating.

FIG. 2 depicts the invention of the related patent, Gelbart, which is a technique to increase the resolution of ink jet printing. Referring now to FIG. 2, the substrate 3 is covered with a thin hydrophobic coating 4 which is not wetted by aqueous liquid ink. The hydrophobic coating 4 can be as thin as a single molecular monolayer coating, provided it is continuous. The ink droplet 1, containing the colorant dispersed or dissolved in a carrying liquid (usually water), is ejected from nozzle 2 towards coating 4. Letters a to f show the steps in the formation of the dot. Because the hydrophobic layer 4 repels the carrier liquid, droplet 1 flattens on the surface upon impact as shown in FIG. 2-*c,* but is pulled back to spherical form as shown in FIG. 2-*d,* by surface tension. The ratio between the surface tension of droplet 1 and the surface energy of coating 4, determines the shape of the droplet 1 after it settles. A higher ratio produces a droplet 1 more spherical in shape and ultimately a smaller final dot 9. However, the surface energy of the hydrophobic layer 4 determines the adhesion strength of the final dot 9, which is required for durability. Consequently, a reduction in surface energy of the hydrophobic layer 4 (desired to achieve small dot size) must be traded off with the fact that lower surface energy reduces the adhesion strength of the final dot 9. The carrier liquid is evaporated in FIG. 2-*e* using heat 5 (or air drying without heat, if time is not important) leaving a very small, dense and round dot. This dot is fused to the substrate by further heating as shown in FIG. 2-*f.* Good adhesion may be achieved if the surface is heated up to the melting point of either coating 4 or the colorant when fusing. Alternatively, any other kind of physical or chemical transformation can be used to improve adhesion. Simply drying the dot produces lower adhesion, which will be sufficient for most applications. In an alternate embodiment durability is achieved by applying an overcoat 6 as depicted in FIG. 2-*g.* A variant of the overcoat is to apply droplets to a clear substrate, which is subsequently laminated to paper.

The hydrophobic anti-wetting 4 coating may be temporary. The required lifetime of the hydrophobic coating is only a few minutes (i.e. it is only required during application and evaporation of the ink droplets) and the layer can be as thin as a single molecular monolayer coating. Therefore, the coating can be formed by directing a volatile vapor of a hydrophobic material, such as a hydrocarbon, at the substrate. Due to adsorption (surface absorption), the vapor will form a monolayer, provided that the substrate is not porous. The hydrophobic layer can then be evaporated after ink droplets are dry.

The anti-wetting coat can be chosen from a wide range of chemicals. Hydrocarbons, waxes and polymers were found to be the best choices for permanent coatings. Lower molecular weight hydrocarbons were found to be suitable for temporary coatings. Acrylic polymers are a good overall choice for permanent coatings as they can be fused well with both dyes and pigments to form a durable print. Hydrocarbons give the smallest dots (lowest wetting) but also the least durability. Increasing the durability by overcoating with a clear acrylic varnish or lamination works well.

Figure 3:
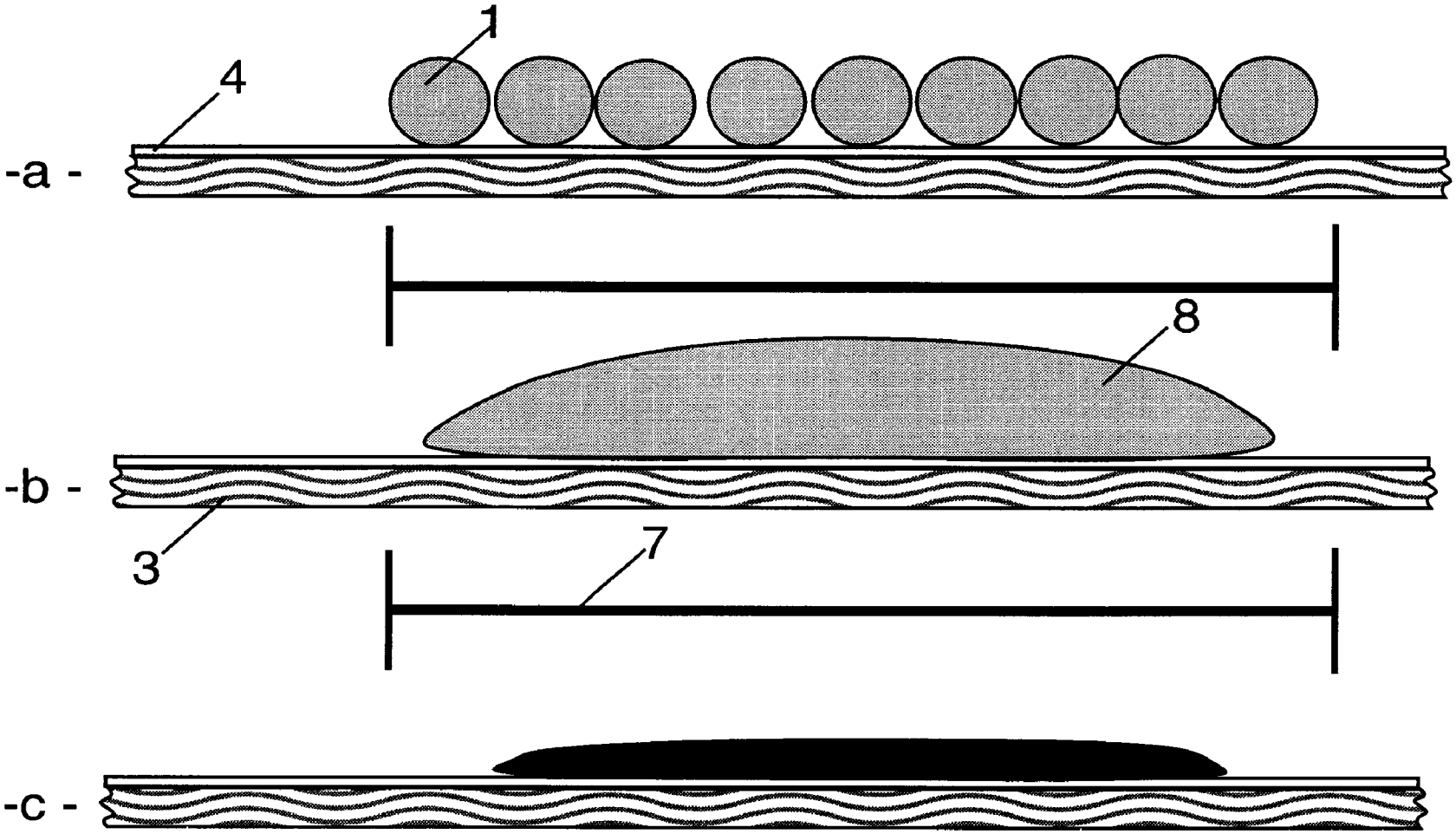
FIG. 3 shows the fusion or coalescing of ink droplets that may occur in the Gelbart process when printing in solid or shadow areas.

FIG. 3 depicts the problems associated with the Gelbart invention, when printing in solid or shadow areas. The indicated region 7 is a shadow or solid area. Consequently, in region 7, the ink droplets 1 are sprayed onto the hydrophobic layer 4 in close proximity. The aforementioned low surface energy of the hydrophobic layer 4 and the high surface tension of the ink droplets 1, will tend to cause the ink droplets 1 to coalesce or fuse together forming a relatively large ink region 8. When the large ink region 8 dries, it is distorted and does not produce the desired shape of solid or shadow in the indicated region 7.

Figure 4:
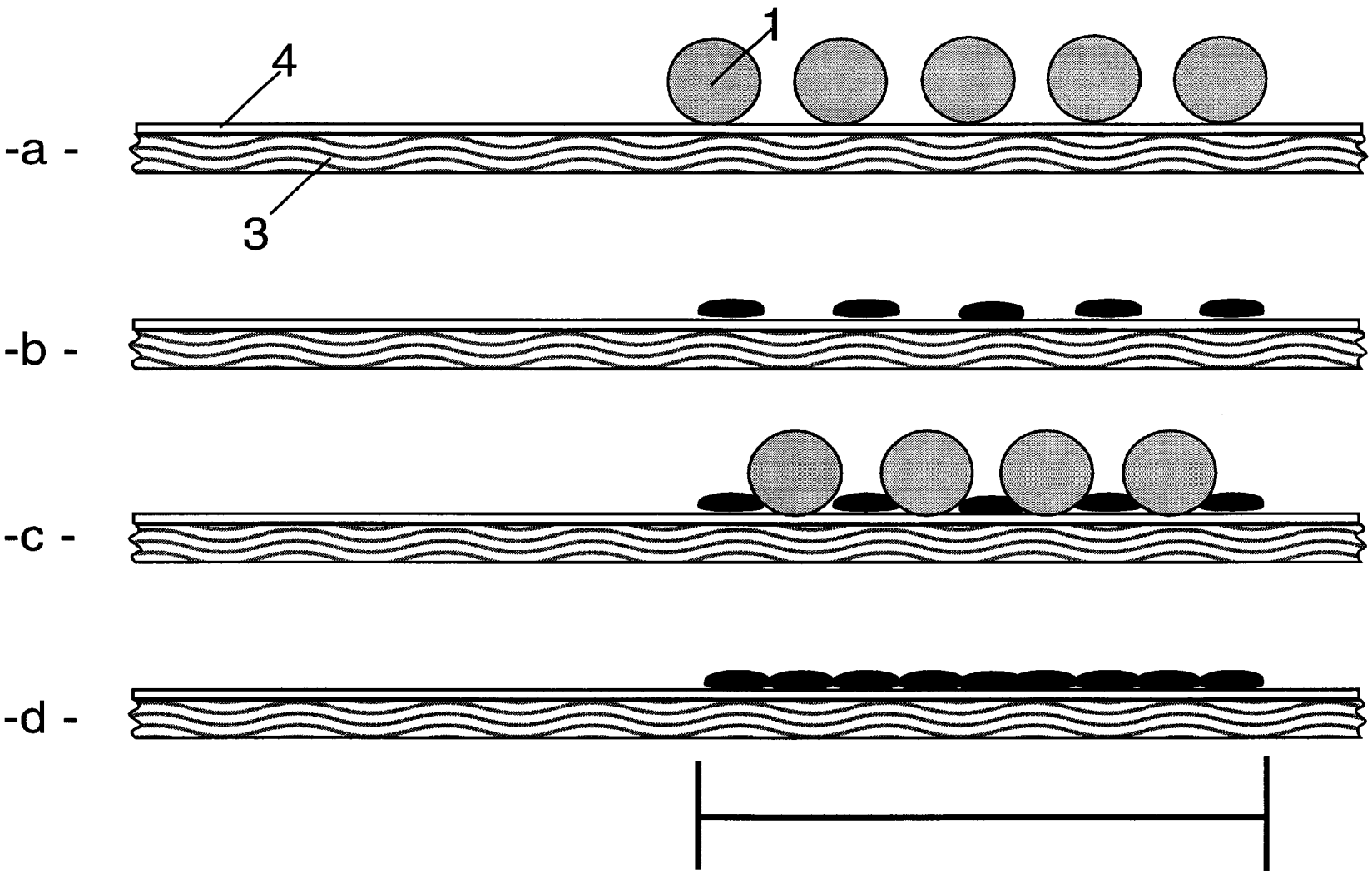
FIG. 4 depicts the steps in the first embodiment of the present invention, wherein multiple printing passes are used and the ink droplets are allowed to dry between each pass.

The first embodiment of this invention is depicted in FIG. 4. In this embodiment, the region to be covered with a shadow or solid 7 receives a multi-pass application of ink. FIG. 4-*a* shows the first application of ink spaced sufficiently far apart, to prevent the coalescing of the aqueous liquid droplets on the hydrophobic surface 4. FIG. 4-*b* simply shows the ink from the first pass drying (i.e. all carrier liquid evaporating). A second pass over the area is then completed (FIG. 4-*c*) and it dries in FIG. 4-*d,* leaving the entire area covered optimally.

Figure 5:
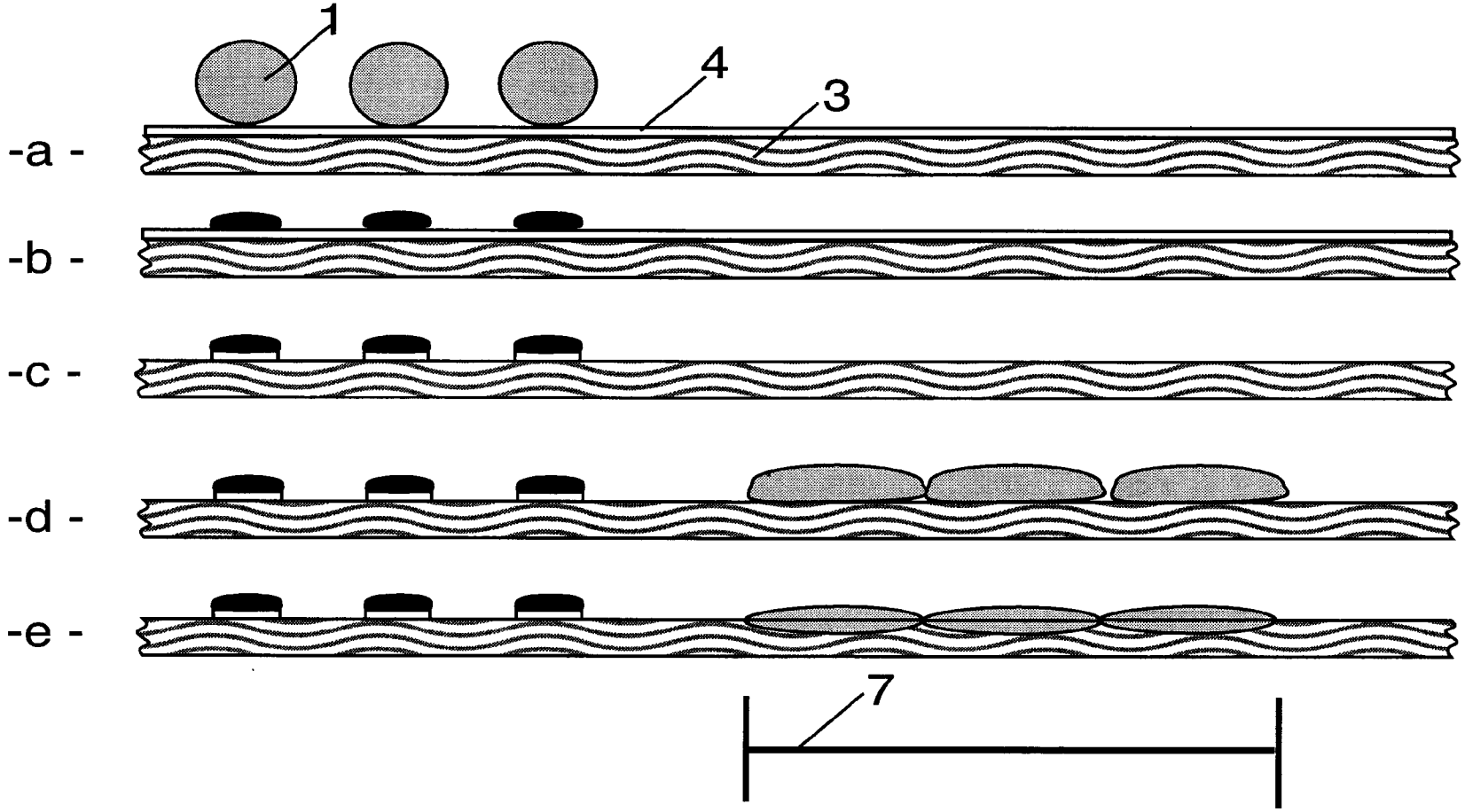
FIG. 5 displays steps in a method according to the first embodiment of the second aspect of the present invention, wherein multiple passes are used to avoid the coalescing problem. A first pass is made to print in highlight areas on the hydrophobic coated substrate. After evaporating the carrier liquid, the hydrophobic coating is removed from the substrate and then a final pass is made applying ink to the solid and shadow areas on the un-coated substrate.

A first embodiment of the second aspect of the invention is depicted in FIG. 5. In this embodiment, a first pass of ink 1 is applied to the highlight areas, on top of the hydrophobic coating 4 This first pass is applied in FIG. 5-*a* and dries in FIG. 5-*b*. This first pass enables the precision afforded by the Gelbart process when applying ink to highlights areas An intermediate step is then performed in FIG. 5-*c,* wherein the hydrophobic surface 4 is removed from the substrate 3. A second pass of ink is then applied to the bare substrate in the solid or shadow areas 7. Without the hydrophobic surface 4, the ink from the second pass wets the substrate and appears as a relatively even coat of ink (FIGS. 5-*d* and 5-*e*). Thus, the benefits of smaller dot size are achieved in the highlight areas by using the Gelbart process in the hydrophobic coating 4, but the integrity of inking in the solid or shadow areas 7 is preserved using conventional wetting of the substrate 3.

The hydrophobic surface 4 can be removed by heating (evaporating the hydrophobic material), by exposure to UV light or by electrical discharge (corona). Exposure to UV light or corona discharge decomposes the hydrophobic material. When the hydrophobic material is volatile, it will evaporate within a short time without requiring any removal processing.

Figure 6:
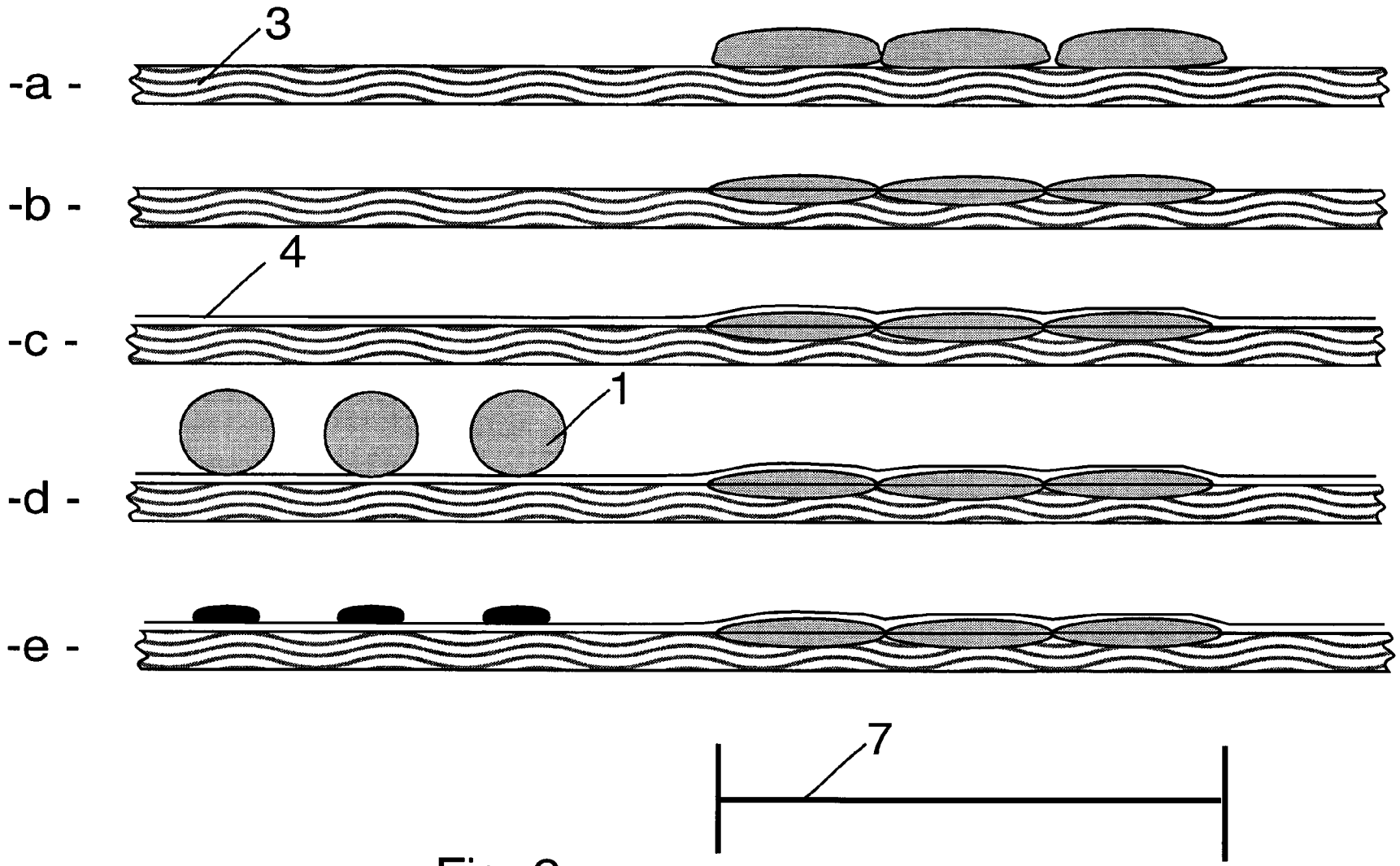
FIG. 6 shows steps in a method according to the second embodiment of the second aspect of the present invention, wherein multiple passes are used to avoid the coalescing problem. A first pass is made to print in solid and shadow areas on the un-coated substrate, then the substrate is coated with a hydrophobic material, after which a final pass is made, applying ink to the highlight areas on top of the hydrophobic coating.

FIG. 6 depicts a second embodiment of the second aspect of the invention that is similar to the above process, except that ink 1 is applied to the bare substrate 3 in a first pass. Without the hydrophobic coating 4, the ink wets the substrate 3 in the conventional manner (FIG. 6-*a* and 6-*b*). In an intermediate step depicted in FIG. 6-*a,* a hydrophobic coating 4 is applied after the first printing pass. Finally, ink is applied to the highlight areas in a second pass (FIGS. 6-*d* and 6-*e*). The ink does not wet the surface because of the hydrophobic layer 4. Consequently, the benefits of smaller dot size are achieved in the highlight areas by using the Gelbart process, but the integrity of inking in the solid or shadow areas 7 is preserved using conventional wetting of the substrate 3.

EXAMPLES

In all following examples, the ink jet printer used is a Hewlett-Packard Desk Jet Model 310, using regular ink. The hydrophobic coating used is a solution of 2% paraffin (white candle wax) in mineral spirits (sold commercially under the name "Odorless Solvent" and containing a mixture of hydrocarbons). Unless specified otherwise, the coating is allowed to dry for about an hour to evaporate the mineral spirits.

Example 1

A sheet of plain paper was treated with the above hydrophobic coating. An image was formed by the above ink jet printer using four separate passes, not exceeding 25% area coverage in each pass. Good solids were obtained while maintaining round highlight dots of about 20 microns. Same paper, when used without the hydrophobic treatment, displayed irregular dots of 50–70 microns.

Example 2

A sheet of plain paper was treated with the above hydrophobic coating and all image parts having screen densities below 10% area coverage were printed by the above ink jet printer. After the printing paper was heated to about 100° C. for a few minutes to remove the hydrophobic coating, the remaining image was printed in one pass. Good highlights and good shadows and solids were achieved, with highlight dots of 20 microns.

Example 3

A sheet of plain paper was printed with all image parts except highlights below 10% area coverage. After printing it was treated with the above hydrophobic treatment and the remaining image was added. The results were similar to examples 1 and 2.

Example 4

This example shows the preparation of a lithographic printing plate using the invention. A standard anodized aluminum printing plate substrate (purchased from City Plate, N.Y.) was wiped with mineral spirits. Before it was dry a half-tone pattern was printed on it with the above ink jet printer using a water based 10% solution of aqueous acrylic latex (BF Goodrich HYCAR #26256) as an ink. Ink jet printing was done in three different ways, following the methods of examples 1, 2, and 3. Results of all three methods were comparable, with methods 2 and 3 giving the best results. After ink jet printing the plate was heated to 80° C. for 1 minute to drive off all of the hydrocarbons, returning the plate to its original hydrophilic state and to fuse the acrylic latex. The performance of the plate as a lithographic printing plate was verified by wetting it with water and rubbing the plate with a wet sponge coated with a small amount of printing ink. Ink adhered only to the fused acrylic latex.

What is claimed is:

1. An ink jet printing method comprising:

(a) rendering a surface of a substrate temporarily hydrophobic by applying a thin coating of a hydrophobic material to the substrate surface;

(b) applying a first set of ink droplets to the surface in a first applying step, the first set of ink droplets not wetting the hydrophobic coating and spaced sufficiently far apart to avoid coalescing;

(c) evaporating carrier liquids from the first set of ink droplets in a first evaporating step, the first evaporating step leaving a first set of small colorant dots on the surface;

(d) applying a second set of ink droplets to the surface in a second applying step at locations interleaved with the small colorant dots, the second set of ink droplets not wetting hydrophobic coating and spaced sufficiently far apart to avoid coalescing;

(e) evaporating carrier liquids from the second set of ink droplets in a second evaporating step, the second evaporating step leaving a second set of small colorant dots on the surface; and (f) repeating the second applying step and the second evaporating step until a required ink coverage is achieved.

2. A method according to claim 1, comprising increasing the durability of the small colorant dots.

3. A method according to claim 2, wherein the durability increasing step comprises heating the surface until the small colorant dots fuse to the surface.

4. A method according to claim 2, wherein the durability increasing step comprises coating the small colorant dots with a protective layer after a required ink coverage is achieved.

5. A method according to claim 2, wherein the durability increasing step comprises laminating the small colorant dots with a protective layer after a required ink coverage is achieved.

6. A method according to claim 1, wherein the surface is selected from a group consisting of paper, coverage is achieved. lithographic printing plates, flexographic printing plates and etch resist masks.

7. An ink jet printing method comprising:

providing a substrate and rendering a surface of the substrate hydrophobic by applying a hydrophobic material to the substrate;

applying a first set of ink droplets to the hydrophobic surface at spaced apart locations, the first set of ink droplets not contacting one another;

allowing carrier liquids to evaporate from the first set of ink droplets to yield a first set of colorant dots on the substrate;

applying a second set of ink droplets to the hydrophobic surface layer at spaced apart locations interleaved with the first set of colorant dots, the second set of ink droplets not contacting one another; and, allowing carrier liquids to evaporate from the second set of ink droplets to yield a second set of colorant dots on the substrate.

8. The method of claim 7 comprising sequentially applying one or more additional sets of ink droplets by:

depositing an additional set of ink droplets onto the hydrophobic surface at spaced apart locations interleaved with previously deposited sets of colorant dots so that the droplets in the additional set of ink droplets do not contact one another;

allowing carrier liquids to evaporate from the additional set of ink droplets to yield an additional set of colorant dots on the substrate; and, if desired, repeating the depositing and evaporation for other additional sets of ink droplets.

9. The method of claim 7 wherein one Bet of ink droplets covers highlight, shadow and solid areas of an image being printed and other ones of the sets of ink droplets cover only shadow and solid areas of the image.

10. The method of claim 1 wherein one set of ink droplets covers highlight, shadow and solid areas of an image being printed and other ones of the sets of ink droplets cover only shadow and solid areas of the image.

11. The method of claim 1 wherein the hydrophobic material comprises a wax.

12. The method of claim 1 wherein the hydrophobic material comprises a hydrocarbon.

13. The method of claim 1 wherein the hydrophobic material comprises a polymer.

14. The method of claim 1 wherein applying a thin coating of a hydrophobic material to the substrate surface comprises directing a vapor of a volatile hydrophobic material at the substrate.

* * * * *